US005352537A

United States Patent [19]

Das et al.

[11] Patent Number: 5,352,537

[45] Date of Patent: * Oct. 4, 1994

[54] PLASMA SPRAYED CONTINUOUSLY REINFORCED ALUMINUM BASE COMPOSITES

[75] Inventors: Santosh K. Das; Michael S. Zedalis, both of Randolph, N.J.; Paul S. Gilman, Suffern, N.Y.

[73] Assignee: AlliedSignal Inc., Morris Township, Morris County, N.J.

[ * ] Notice: The portion of the term of this patent subsequent to Dec. 7, 2009 has been disclaimed.

[21] Appl. No.: 986,395

[22] Filed: Dec. 7, 1992

Related U.S. Application Data

[62] Division of Ser. No. 435,137, Nov. 9, 1989, Pat. No. 5,229,165.

[51] Int. Cl.[5] ..... B22F 7/00

[52] U.S. Cl. ..... 428/549; 428/614; 428/615; 428/627; 428/632; 428/937; 428/553; 428/567

[58] Field of Search ..... 428/548, 614, 615, 627, 428/632, 389, 937, 549, 553, 567

[56] References Cited

U.S. PATENT DOCUMENTS

| | | | |
|---|---|---|---|
| 3,596,344 | 3/1971 | Kreider | 29/419 |
| 3,606,667 | 9/1971 | Kreider | 29/423 |
| 3,615,277 | 10/1971 | Kreider | 29/195 |
| 3,776,297 | 12/1973 | Williford et al. | 164/461 |
| 4,782,884 | 11/1988 | Siemers | 164/46 |
| 4,786,566 | 11/1988 | Siemers | 428/568 |
| 4,805,833 | 2/1989 | Siemers | 228/190 |
| 5,130,209 | 7/1992 | Das et al. | 428/614 |
| 5,217,815 | 6/1993 | Das et al. | 428/549 |

*Primary Examiner*—George F. Lesmes
*Assistant Examiner*—Chris Raimund
*Attorney, Agent, or Firm*—Ernest D. Buff; Roger H. Criss

[57] ABSTRACT

A metal matrix composite is produced by forming a rapidly solidified aluminum base alloy into powder. The powder is plasma sprayed onto at least one substrate having thereon a fiber reinforcing material to form a plurality of preforms. Each of the preforms has a layer of the alloy deposited thereon, and the fiber reinforcing material is present in an amount ranging from about 0.1 to 75 percent by volume thereof. The preforms are bonded together to form an engineering shape.

6 Claims, 3 Drawing Sheets

PLASMA SPRAYED CONTINUOUSLY REINFORCED ALUMINUM BASE COMPOSITES

This application is a division of application Ser. No. 435,137, filed Nov. 9, 1989 now U.S. Pat. No. 5,229,165.

BACKGROUND OF THE INVENTION

1. Field of the Invention

This invention relates to a process for improving the mechanical properties of metals, and more particularly to a process for producing an aluminum composite having a rapidly solidified metal matrix and a continuous fiber reinforcement.

2. Description of the Prior Art

An aluminum based composite generally comprises two components—an aluminum alloy matrix and a hard reinforcing second phase. The reinforcing phase may be discontinuous, e.g., particulate, short fiber, or may be continuous in the form of a fiber or tape. The composite typically exhibits at least one characteristic reflective of each component. For example, a continuous fiber reinforced aluminum based composite should reflect the ductility and fracture toughness of the aluminum matrix as well as reflect of the elastic modulus and strength of the fiber.

Continuous fiber reinforced aluminum based composites are usually limited to ambient temperature applications because of the large mismatch in higher temperature strength between the aluminum matrix (low strength) and the continuous fiber reinforcement (high strength). Another problem with continuous fiber reinforced metal matrix composites produced by mechanically binding continuous fiber between aluminum based matrix foils is the difficulty in producing a bond between the matrix and the fiber. To produce such a bond it is often times necessary to vacuum hot press the material at temperatures higher than the incipient melting temperature of the matrix or higher than the stability of precipitate phases present in the aluminum based matrix. Still another problem with continuous fiber reinforced metal matrix composites produced by cold spraying a rapidly solidified aluminum based matrix mixed with an organic binder onto a continuous fiber preform and then burning off the organic binder is that the organic binder decomposes and forms a deleterious residue within the sprayed preform. An alternative method of fabricating the composites is by plasma spraying. Prior processes in which alloys and/or continuous fiber reinforced metal matrix composites are fabricated by means of plasma or arc spraying are disclosed in U.S. Patent Nos. 3,596,344, 3,606,667, 3,615,277, 4,782,884, 4,786,566, and 4,805,833. However, all the previous work was done using atomized aluminum powder which did not have the metastable microstructure of rapidly solidified aluminum powder. Hence, there is a need for an invention for plasma spraying a rapidly solidified aluminum alloy matrix where rapid enough solidification of the molten powder droplets be attained to retain the microstructure of the starting rapidly solidified alloy.

SUMMARY OF THE INVENTION

It is therefore proposed that the elevated temperature properties of the composite be improved, and that mechanical binding and cold spraying for fabrication be avoided by plasma a rapidly solidified, high temperature aluminum alloy onto continuous fiber preforms.

This procedure, referred to as plasma provides for a high temperature aluminum base matrix free of organic residue and permits the continuous fiber reinforcement to be bonded to the matrix without heating the material to a temperature above the solidus of the matrix. Moreover, this procedure allows for the deposition and retention of a rapidly solidified alloy onto a substrate and the improved ambient and elevated temperature mechanical and physical properties accorded from the resultant microstructure. The plasma sprayed monotapes may be subsequently bonded together using suitable bonding techniques, e.g., diffusion or roll bonding, forming engineering structural components.

Briefly stated, the invention provides a process for producing a rapidly solidified aluminum base metal matrix composite, comprising the steps of:

(a) forming a rapidly solidified aluminum base alloy into a powder;

(b) plasma spraying said powder onto at least one substrate having thereon a fiber reinforcing material to form a plurality of preforms wherein each of said preforms has a layer of said alloy deposited thereon and said fiber reinforcing material is present in an amount ranging from about 0.1 to 75 percent by volume thereof: and (c) bonding said preforms to form an engineering shape.

In addition, the invention provides a composite comprised of a plurality of preforms bonded to form an engineering shape, each of said preforms comprising a substrate having thereon a fiber reinforcing material upon which an aluminum base alloy layer is deposited, said alloy having been rapidly solidified formed into a powder and deposited by plasma spraying, and said fiber reinforcing material being present in an amount ranging from about 0.1 to 75 percent by volume thereof.

The powder has a powder size less than −40 mesh (U.S. Standard Sieve size) when sprayed in a molten state onto a fiber reinforced substrate using plasma spraying techniques, forms a preform monotape. The fiber may be placed directly on a mandrel or on a suitable substrate such as a rolled foil or planar flow cast ribbon. In this manner there is provided a strong bond between the deposited matrix material and the surface of the reinforcing fibers. Moreover, the attractive microstructure and mechanical and physical properties of the rapidly solidified powder or wire are retained. This process may be repeated such that subsequent spraying is done on fibers placed on top of the sprayed monotapes, and the multilayered preforms may be fabricated. Upon completion of the plasma spraying step, the resultant fiber reinforced preforms are bonded together using suitable bonding techniques such as diffusion bonding, roll bonding and/or hot isostatic pressing, to form an engineering shape which is substantially void-free mass. This shape may be subsequently worked to increase its density and provide engineering shapes suitable for use in aerospace components such as stators, wing skins, missile fins, actuator casings, electronic housings and other elevated temperature stiffness and strength critical parts, automotive components such as piston heads, piston liners, valve seats and stems, connecting rods, cam shafts, brake shoes and liners, tank tracks, torpedo housings, radar antennae, radar dishes, space structures, sabot casings, tennis racquets, golf club shafts and the like.

BRIEF DESCRIPTION OF THE DRAWINGS

This invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1:
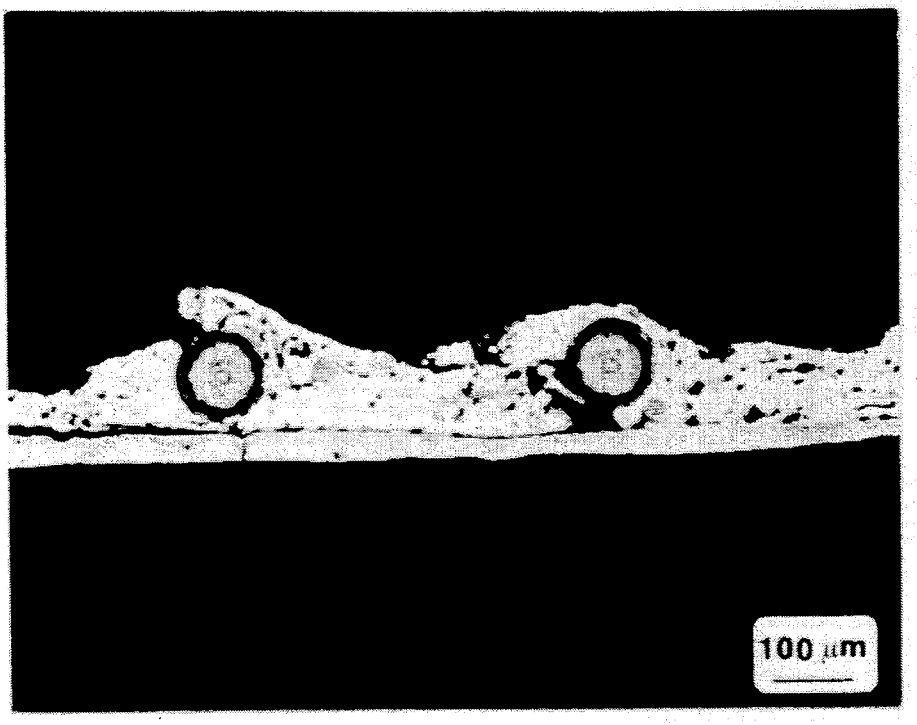
FIG. 1 is a light photomicrograph of a fiber reinforced plasma sprayed monotape composed of rapidly solidified aluminum based iron, vanadium and silicon containing alloy matrix deposited on British Petroleum Sigma monofilament SiC fiber placed upon planar flow cast aluminum based iron, vanadium and silicon containing ribbon fabricated by the present invention.

The aluminum base, rapidly solidified alloy appointed for use in the process of the present invention has a composition consisting essentially of the formula $Al_{bal}Fe_aSi_bX_c$ wherein X is at least one element selected from the group consisting of Mn, V, Cr, Mo, W, Nb, Ta, "a" ranges from 1.5–8.5 at %, "b" ranges from 0.25–5.5 at %, "c" ranges from 0.05–4.25 at % and the balance is aluminum plus incidental impurities, with the proviso that the ratio [Fe+X]:Si ranges from about 2.0:1 to 5.0:1. Examples of the alloy include aluminum-iron-vanadium-silicon compositions wherein the iron ranges from about 1.5–8.5 at %, vanadium ranges from about 0.25–4.25 at %, and silicon ranges from about 0.5–5.5 at %.

Another aluminum base, rapidly solidified alloy suitable for use in the process of the invention has a composition consisting essentially of the formula $Al_{bal}Fe_aSi_bX_c$ wherein X is at least one element selected from the group consisting of Mn, V, Cr, Mo, W, Nb, Ta, "a" ranges from 1.5–7.5 at %, "b" ranges from 0.75–9.5 at %, "c" ranges from 0.25–4.5 at % and the balance is aluminum plus incidental impurities, with the proviso that the ratio [Fe+X]:Si ranges from about 2.0:1 to 1.0:1.

Still another aluminum base, rapidly solidified alloy suitable for use in the process of the invention has a composition consisting essentially of the formula $Al_{bal}Fe_aX_c$ wherein X is at least one element selected from the group consisting of Mn, V, Cr, Mo, W, Nb, Ta, Ce, Ni, Zr, Hf, Ti, Sc, "a" ranges from 1.5–8.5 at % "b" ranges from 0.25–7.0 at %, and the balance is aluminum plus incidental impurities.

Still another aluminum base, rapidly solidified alloy that is suitable for use in the process of the invention has a composition range consisting essentially of about 2–15 at % from the group consisting of zirconium, hafnium, titanium, vanadium, niobium, tantalum, erbium, about 0–5 at % calcium, about 0–5 at % germanium, about 0–2 at % boron, the balance being aluminum plus incidental impurities.

A low density aluminum-lithium base, rapidly solidified alloy suitable for use in the present process has a composition consisting essentially of the formula $Al_{bal}Zr_aLi_bMg_cT_d$, wherein T is at least one element selected from the group consisting of Cu, Si, Sc, Ti, B, Hf, Cr, Mn, Fe, Co and Ni, "a" ranges from 0.05–0.75 at %, "b" ranges from 9.0–17.75 at %, "c" ranges from 0.45–8.5 at % and "d" ranges from about 0.05–13 at % the balance being aluminum plus incidental impurities.

Those skilled in the art will also appreciate that other dispersion strengthened, rapidly solidified alloys may be appointed for use in the process of the present invention.

The metal alloy quenching techniques used to fabricate these alloys generally comprise the step of cooling a melt of the desired composition at a rate of at least about $10^{5°}$ C./sec. Generally, a particular composition is selected, powders or granules of the requisite elements in the desired portions are melted and homogenized, and the molten alloy is rapidly quenched on a chill surface, such as a rapidly moving metal substrate, an impinging gas or liquid.

When processed by these rapid solidification methods the aluminum alloy is manifest as a ribbon, powder or splat of substantially uniform microstructure and chemical composition. The substantially uniformly structured ribbon, powder or splat may then be pulverized to a particulate for plasma spraying.

For the purposes of this specification and claims the term fiber means a ceramic material continuous in length and not of a prescribed diameter or chemical composition. Moreover, the term reinforcement of the composite shall mean (1) an essentially nonmalleable character, (2) a scratch hardness in excess of 8 on the Ridgway's Extension of the MOHS' Scale of Hardness and (3) an elastic modulus greater than 200 GPa. However, for the aluminum matrices of this invention somewhat softer reinforcing fibers such as graphite fibers may be useful. Reinforcing fibers useful in the process of this invention include mono- and multi-filaments of silicon carbide, aluminum oxide including single crystal sapphire and/or aluminum hydroxide (including additions thereof due to its formation on the surface of the aluminum matrix material), zirconia, garnet, cerium oxide, yttria, aluminum silicate, including those silicates modified with fluoride and hydroxide ions, silicon nitride, boron nitride, boron carbide, simple mixed carbides, borides carbo-borides and carbonitrides of tantalum, tungsten, zirconium, hafnium and titanium, and any of the aforementioned fibers impregnated or encompassed with a metal such as aluminum, titanium, copper, nickel, iron or magnesium. In particular, because the present invention is concerned with aluminum based composites that possess a relatively low density and high modulus, silicon carbide and aluminum oxide are desirable as the reinforcing phase. However, depending on the rapidly solidified alloy other fiber reinforcements may prove to form superior matrix/reinforcement bonds. Also, the present specification is not limited to single types of reinforcement or single phase matrix alloys.

In the process of the present invention fibers are initially placed directly on a mandrel or on a suitable substrate such as a rolled foil or planar flow cast ribbon in an amount ranging from about 0.1 to 75 percent by volume of the sprayed monotape. The mandrel may be water or gas cooled, or may be heated directly or indirectly during the processing. The optimum mandrel temperature is dependent on the rapidly solidified alloy and the dispersed phases which must be formed during solidification. The rapidly solidified alloy in the form of powder that can range in size from 0.64 cm in diameter down to less than 0.0025 cm in diameter may then be plasma sprayed onto the fiber-wrapped mandrel. The plasma spraying process comprises the steps of (i) ionizing an inert gas to generate a plasma; (ii) injecting said powder into said plasma; (iii) controlling the residence time of said powder within said plasma to cause said powder to reach a molten state; and (iv) directing said molten powder into said substrate ionized gas plasma is created for example by either a direct current (d.c.) induction coupled or radio frequency power source. Direct current plasma spraying may be performed using a 20 to 40 kW power source and more preferably between 25 to 40 kW of power. Powder flow rate into the ionized plasma is dependent on the velocity of the gas exiting the nozzle of the d.c. plasma spraying unit, for if the powder is introduced into the plasma at too slow of a flow rate it will be blown back and will not enter the plasma, and if the powder is introduced at too rapid a rate, the powder will only partially melt before it impinges on the substrate. Induction coupled plasma spraying may be performed using a 140 to 200 kW power level and more preferably between 150 to 170 kW of power. Powder flow rates into the ionized plasma gas are dependent only on the liquidus temperature of the alloy and the temperature of the plasma. The major advantage of induction coupled plasma spraying compared to d.c. plasma spraying is that the powder residence time in the plasma is estimated to be approximately 70 times greater; thus, larger powder particles can be injected into the plasma and complete melting will occur. The term "optimum flow rate" in the context of the present specification and claims means introducing powder into the plasma at a rate such that the powder is not rejected by the plasma and/or the powder is completely melted prior to it impinging and solidifying on the substrate. The term "optimum vacuum level" in the context of the present specification and claims means regulating the vacuum level in the respective plasma spraying chambers such that the length of the plasma prevents the molten powder droplets from solidifying prior to them striking the substrate, and that the length of the plasma does not itself impinge upon the substrate and result in excessive heating of the substrate which in turn will affect the solidification rate of the deposited molten droplets or the degradation of the deposited layer of powder.

Plasma spraying may be performed for varying lengths of time depending on the thickness of the sprayed preform or monotape required. In this manner there is provided a strong bond between the deposited matrix material and the surface of the reinforcing fibers. Moreover, the attractive microstructure and mechanical and physical properties of the rapidly solidified powder are retained. This process may be repeated such that subsequent spraying is done on fibers placed on top of the sprayed monotapes, and multi-layered preforms may be fabricated.

The fabricated fiber reinforced preforms may be bonded together using suitable bonding techniques such a diffusion bonding, roll bonding and/or hot isostatic pressing, to form an engineering shape which is a substantially void-free mass. Bonding may be performed at temperatures which range from 400° C. to 575° C. and more preferably in the range from 475° C. to 530° C., under applied pressures which range from 7 MPa to 150 MPa and more preferably in the range from 34 MPa to 100 MPa. The applied pressure is dependent on the bonding temperature and optimally will be sufficient to provide a mechanical and chemical bond between preforms, yet will not break or damage the fibers present in the preform. In the case of diffusion bonding or hot isostatic pressing, vacuums greater than 100 microns are preferable. Bonding may be assisted by placing foils or powders composed of commercially pure aluminum or of a suitable alloy which is relatively soft at the bonding temperatures and allows fast diffusion of alloy constituents across the foil/preform boundaries. Moreover, fiber reinforced preforms may be oriented above one another such that the fiber reinforcement may be unidirectional, bi-directional or multi-directional. The number of laminations is dependent on the required size and thickness of the desired engineering shape. This shape may be subsequently worked to increase its density and provide engineering shapes such as sheets and plates suitable for use in aerospace, automotive and miscellaneous components.

EXAMPLE I

Rapidly solidified, planar flow cast ribbon of the composition aluminum balance, 4.06 at % iron, 0.70 at % vanadium, 1.51 at % silicon (hereinafter designated alloy A) was wrapped on about a 30 cm diameter steel mandrel. British Petroleum Sigma monofilament SiC fiber (hereinafter designated BP fiber) was then wrapped on top of the planar flow cast substrate. The BP fiber has an average diameter of about 104 micrometers and was wrapped in a helical configuration with about a 300 micrometer spacing. −80 mesh (U.S. standard sieve size) alloy A powder was then plasma sprayed onto the BP fiber wrapped mandrels for approximately 8 min. Plasma spraying was performed at 165 kW to deposit the required layer of rapidly solidified alloy A. FIG. 1 is a light photomicrograph of fiber reinforced plasma sprayed monotapes composed of rapidly solidified aluminum base alloy A deposited on BP placed upon planar flow cast aluminum based alloy A ribbon fabricated by the present invention. Minor amounts of porosity may be observed, however, discrete primary intermetallic compound particles are not seen in the matrix alloy A microstructure indicating that solidification of the plasma sprayed powders occurs at a rate rapid enough to suppress the formation of coarse primary dispersoid particles.

EXAMPLE II

Figure 2:
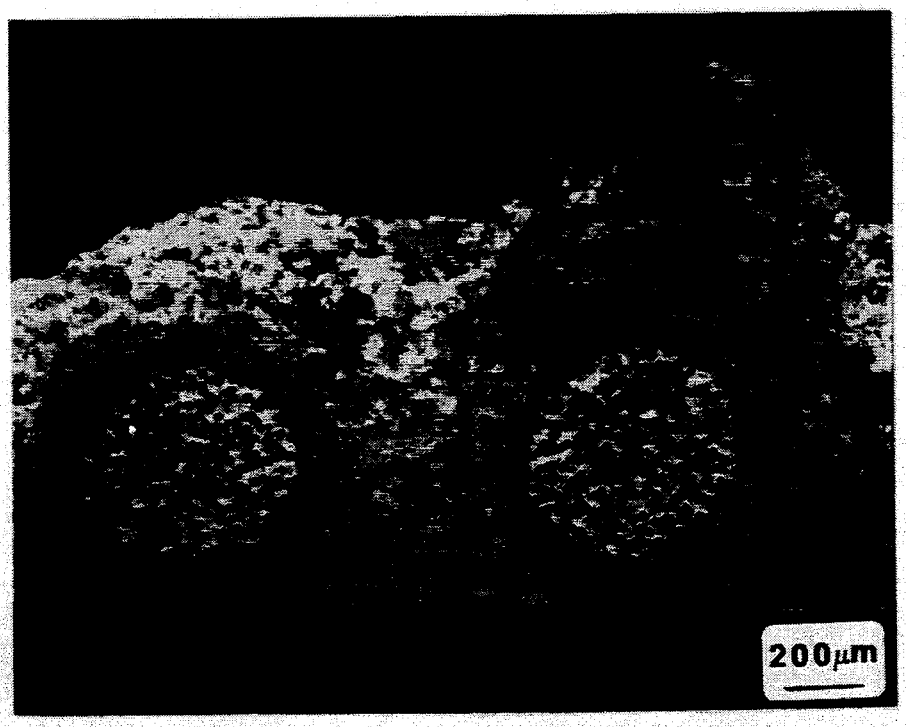
FIG. 2 is a light photomicrograph of a fiber reinforced plasma sprayed monotape composed of rapidly solidified aluminum based iron, vanadium and silicon containing alloy matrix deposited on Nicalon multi-filament SiC fiber impregnated with aluminum, placed upon planar flow cast aluminum based iron, vanadium and silicon containing ribbon fabricated by the present invention.

Rapidly solidified, planar flow cast ribbon of the composition aluminum balance, 4.06 at % iron, 0.70 at % vanadium, 1.51 at % silicon (hereinafter designated alloy A) was wrapped on about a 30 cm diameter steel mandrel. Nicalon multifilament SiC fiber impregnated with aluminum (hereinafter designated Nicalon fiber) was then wrapped on top of the planar flow cast substrate. The Nicalon fiber has an average diameter of about 500 micrometers and was wrapped with about a 1500 micrometer spacing −80 mesh (U.S. standard sieve size) alloy A powder was then plasma sprayed onto the Nicalon fiber wrapped mandrels for approximately 60 min. Plasma spraying was performed at 165 kW to deposit the required layer of rapidly solidified alloy A. FIG. 2 is a light photomicrograph of fiber reinforced plasma sprayed monotapes composed of rapidly solidified aluminum base alloy A deposited on Nicalon fibers, placed upon planar flow cast aluminum based alloy A ribbon fabricated by the present invention. Minor amounts of porosity may be observed, however, discrete primary intermetallic compound particles are not seen in the matrix alloy A microstructure indicating that solidification of the plasma sprayed powders occurs at a rate rapid enough to suppress the formation of coarse primary dispersoid particles.

EXAMPLE III

Figure 3:
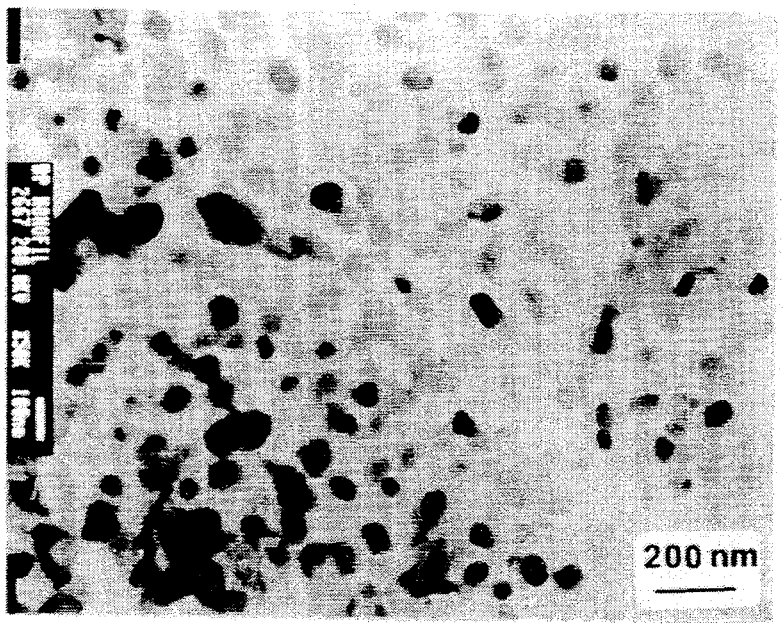
FIG. 3 is a transmission electron photomicrograph of a deposited layer plasma composed of rapidly solidified aluminum based iron, vanadium and silicon containing alloy.

Transmission electron microscopy (TEM) was performed on plasma sprayed deposited layers composed of alloy A to further examine the microstructure of the deposited layer. Samples were prepared by mechanically grinding off the planar flow cast alloy A substrate ribbon and thinning the sample to approximately 25 microns in thickness. TEM foils were prepared by conventional electro-polishing techniques in an electrolyte consisting of 80 percent by volume methanol and 20 percent by volume nitric acid. Polished TEM foils were examined in a philips EM 400T electron microscope. Transmission electron photomicrographs of a plasma sprayed deposited layer composed of rapidly solidified aluminum based iron, vanadium and silicon containing alloy is shown in FIG. 3.

EXAMPLE IV

Figure 4:
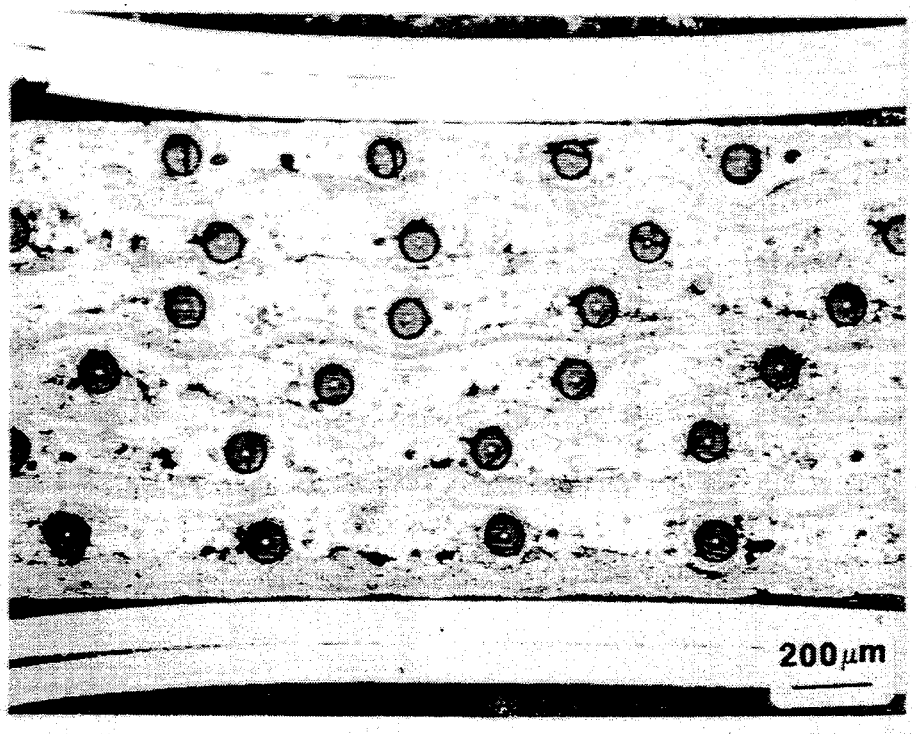
FIG. 4 is a photomicrograph of diffusion bonded layers of plasma sprayed monotapes composed of rapidly solidified aluminum based iron, vanadium and silicon containing alloy matrix deposited on British Petroleum Sigma monofilament SiC fiber placed upon planar flow cast aluminum based iron, vanadium and silicon containing ribbon fabricated by the present invention.

Plasma sprayed monotapes of BP fiber reinforced composites were diffusion bonded for preliminary mechanical property screening. Two layers of rapidly solidified, planar flow cast aluminum based 2.37 at % iron, 0.27 at % vanadium and 1.05 at % silicon containing alloy ribbon, approximately five centimeters by ten centimeters in dimension, were placed in between six layers of BP fiber reinforced plasma sprayed monotapes of approximately the same size as fabricated by the conditions prescribed to in Example I. Diffusion bonding was performed for a period of 1 hr. in a 445 kN vacuum hot press, at a temperature of approximately 500° C., under a pressure of approximately 50 $MN/m^2$, and in a vacuum less than 10 microns of mercury. Photomicrographs of diffusion bonded layers of plasma sprayed monotapes composed of rapidly solidified aluminum base alloy A deposited on BP fiber placed upon planar flow cast aluminum base alloy A containing ribbon fabricated by the present invention is shown in FIG. 4.

EXAMPLE V

Figure 5:
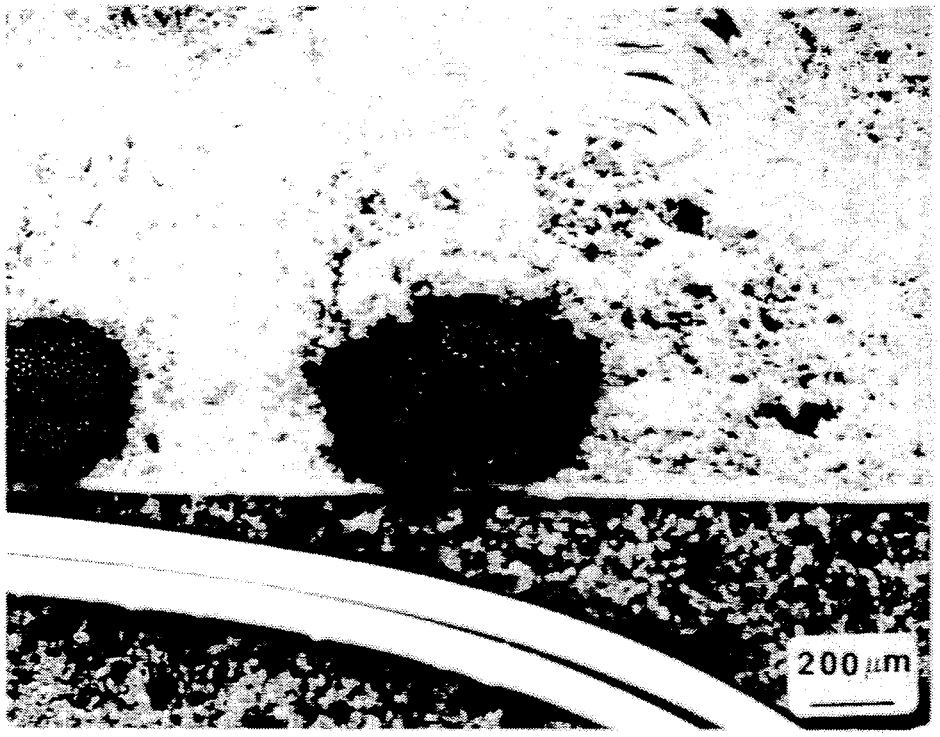
FIG. 5 is a photomicrograph of diffusion bonded layers of plasma sprayed monotapes composed of rapidly solidified aluminum based iron, vanadium and silicon containing alloy matrix deposited on Nicalon multifilament SiC fiber impregnated with aluminum, respectively, placed upon planar flow cast aluminum based iron, vanadium and silicon containing ribbon fabricated by the present invention.

Plasma sprayed monotapes of Nicalon fiber reinforced composites were diffusion bonded for preliminary mechanical property screening. Six layers of rapidly solidified, planar flow cast aluminum based 2.37 at % iron, 0.27 at % vanadium and 1.05 at % silicon containing alloy ribbon, approximately five centimeters by ten centimeters in dimension, were placed in between two layers of Nicalon fiber reinforced plasma sprayed monotapes of approximately the same size as fabricated by the conditions prescribed to in Example II. Diffusion bonding was performed for a period of 1 hr. in a 445 kN vacuum hot press, at a temperature of approximately 500° C., under a pressure of approximately 50 $MN/m^2$, and in a vacuum less than 10 microns of mercury. Photomicrographs of diffusion bonded layers of plasma sprayed monotapes composed of rapidly solidified aluminum base alloy A deposited on Nicalon fiber placed upon planar flow cast aluminum base alloy A containing ribbon fabricated by the present invention is shown in FIG. 5.

EXAMPLE VI

Small dog bone tensile specimens of plasma sprayed and diffusion bonded samples of BP and Nicalon fiber reinforced alloy A composites were mechanically tested to determine their ambient temperature and 482° C. fracture strength (F.S.). Tests were performed on an Instron Model 1125 tensile machine. Static Young's modulus (E), a measure of the material stiffness, was also tested using a clip on strain gauge during tensile testing at ambient temperature. Ambient and 482° C. fracture strength and ambient temperature Young's modulus for the plasma sprayed and diffusion bonded samples of BP and Nicalon fiber reinforced alloy A composites are listed in Table I.

TABLE 1

Ambient and 482° C. Fracture Strength (F.S.) and Ambient Temperature Young's Modulus (E) for the Plasma Sprayed and Diffusion Bonded Samples of BP and Nicalon Fiber Reinforced Alloy A Composites

| Cont. Fiber Reinforced Composite Sample Comp. | Test Temp. (°C.) | F.S. ($MN/m^2$) | E* ($GN/m^2$) |
|---|---|---|---|
| Alloy A/BP Fiber | 25 | 258 | 105 |
| " | 482 | 61 | NM |
| Alloy A/Nicalon Fiber | 25 | 114 | 57 |
| " | 482 | 101 | NM |

*NM refers to not measured.

Having thus described the invention in rather full detail, it will be understood that such detail need not be strictly adhered to by that further changes and modifications may suggest themselves to one skilled in the art, all falling within the scope of the invention as defined by the subjoined claims.

We claim:

1. A composite comprised of a plurality of preforms bonded to form an engineering shape, each of said preforms comprising a substrate having thereon a fiber reinforcing material upon which an aluminum base alloy layer is deposited, said alloy having been rapidly solidified to produce therein a metastable structure, formed into a powder and deposited by plasma spraying at a powder flow rate and vacuum level adjusted to retain said metastable structure, and said fiber reinforcing material being present in an amount ranging from about 0.1 to 75 percent by volume thereof.

2. A composite as recited in claim 1, wherein said alloy is an aluminum-iron-vanadium-silicon alloy.

3. A composite as recited in claim 1, wherein said composite is strongly bonded to said fiber reinforcing material.

4. A composite as recited in claim 1, having the form of a consolidated, mechanically formable, substantially void-free mass.

5. A composite as recited in claim 4, wherein said preforms are oriented above one another such that fiber reinforcement is unidirectional, bi-directional or multi-directional.

6. A composite as recited in claim 1, wherein said engineering shape is a sheet or plate.

* * * * *